US005922231A

United States Patent [19]

Karst et al.

[11] Patent Number: 5,922,231

[45] Date of Patent: Jul. 13, 1999

[54] VOLTAGE SURGE RESISTANT POSITIVE TEMPERATURE COEFFICIENT HEATER

[75] Inventors: Eric Karst, Fort Wayne; Jeff Clark, Auburn, both of Ind.

[73] Assignee: Dekko Heating Technologies, Inc., North Webster, Ind.

[21] Appl. No.: 08/855,620

[22] Filed: May 13, 1997

[51] Int. Cl.[6] ..... H05B 1/02

[52] U.S. Cl. ..... 219/505; 219/504; 219/538; 219/541; 219/542; 338/22 R; 338/22 SC

[58] Field of Search ..... 219/504, 505, 219/538, 542, 544, 552, 553; 338/22 R, 22 SC

[56] References Cited

U.S. PATENT DOCUMENTS

| | | | |
|---|---|---|---|
| 4,544,828 | 10/1985 | Shigenobu et al. | 219/216 |
| 4,545,926 | 10/1985 | Fouts, Jr., et al. | 252/511 |
| 4,560,498 | 12/1985 | Horsma et al. | 252/511 |
| 4,687,904 | 8/1987 | Melanson et al. | 219/271 |
| 4,716,276 | 12/1987 | Motegi et al. | 219/253 |
| 4,731,522 | 3/1988 | Manchester | 219/275 |
| 4,734,560 | 3/1988 | Bowen | 219/271 |
| 4,758,708 | 7/1988 | Manchester | 219/272 |
| 4,780,286 | 10/1988 | Parent et al. | 422/125 |
| 4,822,980 | 4/1989 | Carbone et al. | 219/315 |
| 4,822,983 | 4/1989 | Bremner et al. | 219/505 |
| 4,853,517 | 8/1989 | Bowen et al. | 219/271 |
| 4,874,924 | 10/1989 | Yamamoto et al. | 219/274 |
| 5,414,241 | 5/1995 | Ohashi et al. | 219/219 |
| 5,471,035 | 11/1995 | Holmes | 219/505 |

*Primary Examiner*—Mark Paschall
*Attorney, Agent, or Firm*—Taylor & Associates, P.C.

[57] ABSTRACT

The invention is directed to a positive temperature coefficient heater. A pair of electrical conductors are connected to a positive temperature coefficient body at respective locations. A dielectric material is attached to the body between the conductors and prevents electrical arcing around the body between the conductors.

16 Claims, 1 Drawing Sheet

VOLTAGE SURGE RESISTANT POSITIVE TEMPERATURE COEFFICIENT HEATER

BACKGROUND OF THE INVENTION

1. Field of the Invention

The present invention relates to positive temperature coefficient heaters, and, more particularly, to positive temperature coefficient heaters which may be exposed to high voltage spikes or surges.

2. Description of the Related Art

A positive temperature coefficient (PTC) heater includes a semi-conductive body with an electrical resistance which varies as a function of temperature. Electrical conductors are typically attached to opposite surfaces of the body and an electrical current is passed through the body during use. The electrical current passing through the body causes the temperature of the body to rise. As the temperature of the body rises, the electrical resistance of the body also increases.

A PTC heater may occasionally be exposed to high voltage spikes or surges during use. The PTC heater is typically not protected from the high voltage spikes and surges. The semi-conductive electrical properties of the body of the PTC heater may not allow the electrical current associated with the voltage spike to pass therethrough in a sufficient manner with respect to time. As a result, an electrical potential may develop between the electrical conductors at the opposing surfaces of the body which in turn may result in the formation of an electric field at the input side of the body. The electric field may result in arcing around the periphery of the PTC heater, rendering the surface of the PTC heater conductive because of carbonization by the arc flame. In the course of arcing, the PTC heater may suffer cracking or pitting, or may become brittle due to the heat of the arcing.

Devices are known which cut off power to or limit power through a PTC heater when it has reached a certain temperature to prevent damage to the PTC heater from excessive heat. But these devices are designed to protect the PTC heater in the normal household voltage operating range. These devices are not designed to protect the PTC heater from voltage spikes or surges in the kilovolt range, and the devices cannot react quickly enough to do so.

What is needed in the art is a way to protect the PTC heater from damage from high voltage spikes or surges.

SUMMARY OF THE INVENTION

The present invention provides a positive temperature coefficient heater capable of withstanding high voltage spikes or surges without sustaining significant damage therefrom.

The invention comprises, in one form thereof, a positive temperature coefficient heater. A pair of electrical conductors are connected to a positive temperature coefficient body at respective locations. A dielectric material is attached to the body between the conductors and prevents electrical arcing around the body between the conductors.

An advantage of the present invention is that the PTC heater may be exposed, with minimal damage, to high voltage spikes or surges.

Another advantage is that the dielectric material occupies very little space and thus may be easily incorporated into almost any existing PTC heater design.

Yet another advantage is that the voltage surge resistant PTC heater is very easy and inexpensive to manufacture.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
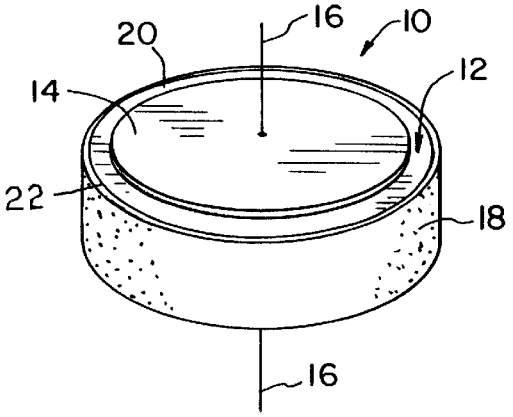
FIG. 1 is a perspective view of one embodiment of a voltage surge resistant PTC heater of the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Figure 2:
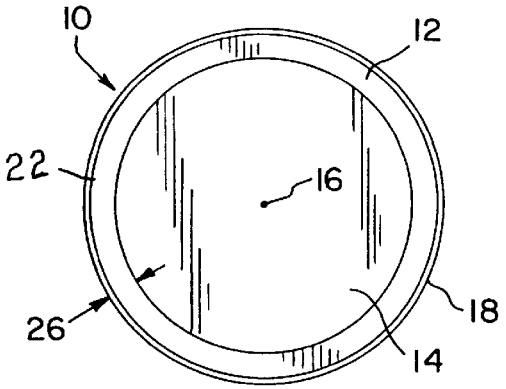
FIG. 2 is a top view of the voltage surge resistant PTC heater shown in FIG. 1.
Figure 3:
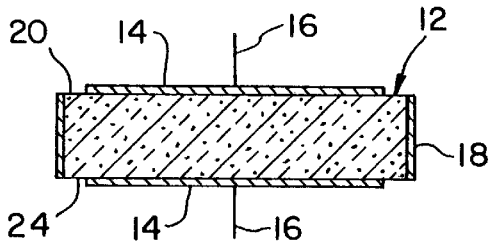
FIG. 3 is a side view of the voltage surge resistant PTC heater shown in FIG. 1.

Referring now to the drawings and particularly to FIGS. 1–3, there is shown an embodiment of a surge resistant PTC heater 10 of the present invention including a PTC body 12, electrodes 14, electrical conductors 16 and dielectric material 18.

PTC body 12 is made of a material having electrical characteristics, such as resistance, which increase with temperature. PTC body 12 includes a top surface 20, side 22 and bottom surface 24. Side 22 is annular and continuous around PTC body 12 (FIG. 2). In the embodiment shown in FIG. 1, PTC body 12 is disc-shaped with a diameter which may vary from between 0.25 and 2 inches (preferably about 0.312 inches), and a thickness which may vary from between 1.5 and 8 millimeters (preferably about 3 millimeters). However, it is to be understood that PTC body 12 may be differently sized and may be configured with any desired geometric shape. For example, PTC body 12 may be cube-shaped or round.

Electrodes 14 are attached to PTC body 12 and connect conductors 16 with PTC body 12. In the embodiment shown, electrodes 14 are attached to opposing top and bottom surfaces 20 and 24. Electrodes 14 are configured as partial face electrodes in FIGS. 1–3, with a gap 26 existing between electrodes 14 and side 22. Gap 26 is preferably about 1 millimeter in the embodiment shown in FIGS. 1–3. Alternatively, electrodes 14 may be configured as full face electrodes, covering the entire area of top surface 20 and bottom surface 24 (not shown).

Dielectric material 18 is attached to side 22. Dielectric material 18 is fabricated from an insulating dope having a relatively high dielectric strength. That is, dielectric material 18 has a relatively high electrical resistance. In one embodiment, dielectric material 18 is a 10-5012 spray-type corona dope manufactured by GC Electronics, Rockford, Ill., U.S.A.

During manufacture, dielectric material 18 is fabricated by applying at least one layer of insulating dope, which may be in liquid form, to side 22. In the embodiment shown, three layers of 10-5012 spray-type corona dope are applied to side 22. Each layer of the corona dope is allowed to dry for one hour at room temperature and one-half hour in an air-circulating oven at 100° C. before the next layer of the corona dope is applied.

During use, an alternating current voltage source (not shown) is connected across conductors 16 and electrodes 14 attached to top surface 20 and bottom surface 24. The voltage source typically provides voltage in the range of household voltage, i.e., between approximately 100 to 500 volts alternating current (VAC). But voltage spikes or surges of up to 6000 volts can occasionally be seen due to lightning strikes, etc. Dielectric material 18 provides a non-conductive gap over which electric current must arc, thus increasing the effective distance of the gap between electrodes 14 at the side 22 of PTC body 12, and the breakdown voltage required before arcing can occur. Dielectric material 18 also protects side 22 from being rendered conductive because of the carbon tracks that would otherwise be formed on side 22 by the arc flame.

Figure 4:
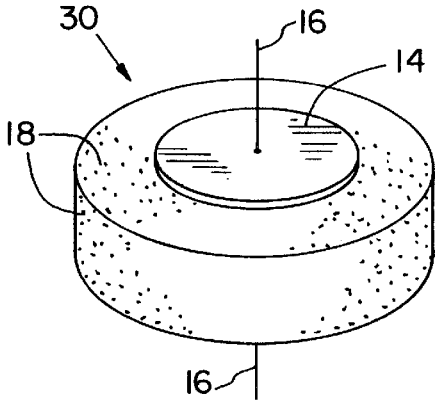
FIG. 4 is a perspective view of another embodiment of a voltage surge resistant PTC heater of the present invention.

Referring now to FIG. 4, another embodiment of a PTC heater 30 of the present invention includes dielectric material 18 which is attached to top surface 12 and/or bottom surface 20 of PTC body 12. Dielectric material 18 covers all of top surface 20 and/or bottom surface 24 not covered by the opposing electrodes 14. Configured as such, dielectric material 18 further widens the non-conductive gap between electrodes 14 over which arcing must occur and protects top surface 20 and bottom surface 24 from carbonization.

Figure 5:
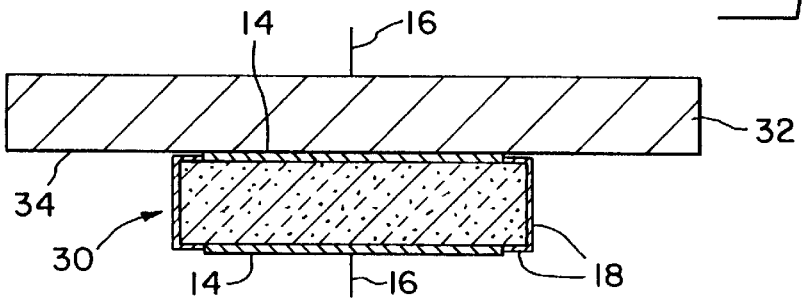
FIG. 5 is a side view of the PTC heater shown in FIG. 4, when attached to a heatsink.

PTC heater 30 may be connected to a heatsink 32 dependent upon the heat transfer requirements of a particular application (FIG. 5). More particularly, an electrode 14 may be attached to each of body 12 and heatsink 32. Dielectric material 18 has a thickness which is slightly less than the thickness of electrode 14, and therefore does not interfere with attachment between electrode 14 and heatsink 32.

Figure 6:
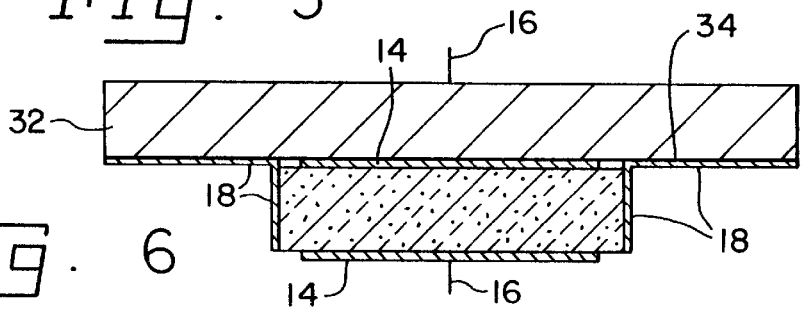
FIG. 6 is a side view of yet another embodiment of a voltage surge resistant PTC heater of the present invention attached to a heatsink.

Heatsink 24 is wider than PTC body 12, and heatsink face 34 thereby provides a potential conductive path for arcing to electrode 14 on bottom surface 24. To prevent such arcing, dielectric material 18 may also be attached to heatsink face 34 (FIG. 6).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A positive temperature coefficient heater, comprising:

a positive temperature coefficient body having an outside surface, said outside surface including a first end area, a second end area, and at least one side surface extending between and interconnecting said first end area and said second end area, at least one of said first end area and said second end area being at least partially exposed to an ambient environment;

a first electrical conductor connected to said first end area of said outside surface of said body;

a second electrical conductor connected to said second end area of said outside surface of said body; and a dielectric material attached to and substantially covering each said side surface of said outside surface of said body.

2. The heater of claim 1, wherein said body is disc-shaped, said body further having a top surface and a bottom surface, said pair of conductors being connected to said top surface and said bottom surface, said side being annular and continuous.

3. The heater of claim 2, wherein said dielectric material covers substantially all of said side.

4. The heater of claim 2, wherein said dielectric material is further attached to said top surface.

5. The heater of claim 2, wherein said dielectric material is further attached to said bottom surface.

6. The heater of claim 1, wherein said dielectric material comprises at least one layer of insulating dope.

7. The heater of claim 6, wherein said dielectric material comprises three layers of insulating dope.

8. The heater of claim 6, wherein said insulating dope has a relatively high dielectric strength.

9. The heater of claim 1, further comprising a pair of electrodes attached to said body and respectively interconnecting said conductors with said body.

10. The heater of claim 9, wherein said body has a top surface and a bottom surface, said electrodes comprising partial face electrodes respectively attached to and covering a portion of said top surface and said bottom surface, said dielectric material covering all of said top surface and said bottom surface not covered by said respective electrodes.

11. The heater of claim 9, further comprising a heatsink having a face, one of said electrodes interconnecting said body with said face.

12. The heater of claim 11, wherein said dielectric material is further attached to said face.

13. The heater of claim 1, wherein said dielectric material defines a means for preventing electrical arcing around the body between the conductors.

14. The positive temperature coefficient heater of claim 1, wherein each of said first end area and said second end area is substantially entirely exposed to said ambient environment.

15. A positive temperature coefficient heater, comprising:

a positive temperature coefficient body having an outside surface, said outside surface including a first end area, a second end area, and at least one side surface extending between and interconnecting said first end area and said second end area, each of said first end area and said second end area being at least partially exposed to an ambient environment, said second end area being disposed substantially opposite said first end area on said outside surface of said body;

a first electrical conductor connected to said first end area of said outside surface of said body;

a second electrical conductor connected to said second end area of said outside surface of said body; and a dielectric material attached to and substantially covering each said side surface of said outside surface of said body.

16. A positive temperature coefficient heater, comprising:

a positive temperature coefficient body having an outside surface, said outside surface including a first end area, a second end area, and a closed-loop middle area disposed between said first end area and said second end area, said closed-loop middle area surrounding each of said first end area and said second end area on said outside surface, each of said first end area and said second end area being at least partially exposed to an ambient environment;

a first electrical conductor connected to said first end area of said outside surface of said body;

a second electrical conductor connected to said second end area of said outside surface of said body; and a dielectric material attached to and covering said closed-loop middle area of said outside surface of said body.

* * * * *